US009308462B1

(12) United States Patent
Huang et al.

(10) Patent No.: US 9,308,462 B1
(45) Date of Patent: Apr. 12, 2016

(54) TOY MODEL AIRCRAFT

(71) Applicant: Shenzhen Hubsan Intelligent Co., Ltd., Shenzhen (CN)

(72) Inventors: Zhanming Huang, Shenzhen (CN); Zhuocheng Luo, Shenzhen (CN); Guangyao Chen, Shenzhen (CN)

(73) Assignee: SHENZHEN HUBSAN INTELLIGENT CO., LTD., Shenzhen (CN)

( * ) Notice: Subject to any disclaimer, the term of this patent is extended or adjusted under 35 U.S.C. 154(b) by 0 days.

(21) Appl. No.: 14/606,262

(22) Filed: Jan. 27, 2015

(30) Foreign Application Priority Data

Nov. 19, 2014 (CN) ..... 2014 1 0658671

(51) Int. Cl.
*A63H 27/00* (2006.01)

(52) U.S. Cl.
CPC ..... *A63H 27/02* (2013.01)

(58) Field of Classification Search
CPC ..... A63H 27/00; A63H 27/001; A63H 27/02; A63H 33/06; A63H 33/062; A63H 33/065; A63H 33/08; A63H 33/086; A63H 33/108; A63H 33/102; A63H 33/10; A63H 33/101; A63H 33/088
See application file for complete search history.

(56) References Cited

U.S. PATENT DOCUMENTS 3,640,491 A * 2/1972 Harrison ..... B64C 1/00 244/117 R
3,935,664 A * 2/1976 Neuhierl ..... A63H 27/001 244/120
4,012,155 A * 3/1977 Morris ..... F16B 7/0413 24/625
4,494,940 A * 1/1985 Gretz ..... A63H 27/02 446/61
5,035,382 A * 7/1991 Lissaman ..... A63H 27/00 244/120
5,954,562 A * 9/1999 Chen ..... A63H 33/10 446/103
6,048,247 A * 4/2000 Kownacki ..... F01B 17/02 446/4
6,123,492 A * 9/2000 Pickard ..... B65D 19/0095 411/339
6,186,854 B1 * 2/2001 Lai ..... A63H 27/02 446/34
6,612,893 B2 * 9/2003 Rehkemper ..... A63H 27/02 446/34
6,726,148 B2 * 4/2004 Carroll ..... B64C 39/024 206/335
6,986,695 B2 * 1/2006 Frontera Castaner . A63H 27/02 244/87
7,182,666 B2 * 2/2007 Frontera Castaner . A63H 27/02 446/36
8,939,810 B1 * 1/2015 Suknanan ..... A63H 27/02 446/34
2004/0075028 A1 * 4/2004 Wang ..... A63H 27/02 244/154
2004/0248496 A1 * 12/2004 Harvey ..... A63H 27/02 446/61
2005/0082428 A1 * 4/2005 Frontera Castaner . A63H 27/02 244/104 LS
2006/0091258 A1 * 5/2006 Chiu ..... B64C 1/00 244/119
2008/0149758 A1 * 6/2008 Colgren ..... B64C 9/02 244/13

* cited by examiner

*Primary Examiner* — Gene Kim
*Assistant Examiner* — Alyssa Hylinski
(74) *Attorney, Agent, or Firm* — IPro, PLLC; Na Xu

(57) ABSTRACT

The present disclosure provides a model aircraft, comprising a body, a wing and a vertical tail. At least one first male female buckle is provided between the wing and the body. The wing is configured to be securely mounted on the body by the first male female buckle. At least one second male female buckle is provided between the vertical tail and the body. The vertical tail is configured to be securely mounted on the body by the second male female buckle. In the disclosed model aircraft, the wing and the vertical tail can be removably assembled on the body by multiple male female buckles. It is structurally simple; it is convenient to disassemble the aircraft during storage to save space, and it is convenient and fast to assemble the aircraft during use, thereby improving the ease of assembly.

20 Claims, 6 Drawing Sheets

TOY MODEL AIRCRAFT

TECHNOLOGY FIELD

The present disclosure relates to field of model toys, in particular to a kind of a toy model aircraft.

BACKGROUND

Toy model aircrafts generally require disassembly into parts during storage and transportation, and the parts are separately stored in order to save storage space. Currently, the disassembly of the majority of toy model aircraft airplanes involves separating a wing into two halves, separating a body into two halves, with a horizontal tail and a vertical tail being two independent parts to be respectively disassembled from the body. Therefore, the entire disassembly and assembly process of the aircraft are both complicated and time-consuming.

SUMMARY

The present disclosure provides a model aircraft that is structurally simple and easy to disassemble and assemble.

To realize the above purpose, the present disclosure provides a model aircraft comprising a body, a wing and a vertical tail. The model aircraft further comprises at least one first male female buckle and at least one second male female buckle. The wing is configured to be mounted on the body by the first male female buckle. The vertical tail is configured to be mounted on the body by the second male female buckle.

Furthermore, the first male female buckle comprises a first male buckle member and a first female buckle member that are configured to cooperate with each other. The first male buckle member is configured to be mounted on the wing, the first female buckle member is configured to be mounted on the body, and the first male buckle member and the first female buckle member are configured to cooperate to secure the wing on the body. Alternatively, the first male buckle member is configured to be mounted on the body, the first female buckle member is configured to be mounted on the wing, and the first male buckle member and the first female buckle member are configured to cooperate to secure the wing on the body.

Furthermore, a mounting groove is provided at a bottom of the wing. An end of the first male buckle member is configured to be secured in the mounting groove. A mounting hole is provided at a bottom of the body, and an end of the first female buckle member is configured to pass through the mounting hole and is configured to be stopped by a bottom of the mounting hole.

Furthermore, the first male buckle member comprises an inserting axis and a plurality of connecting arms formed from an extension of an end of the inserting axis. A free end of one of the plurality of connecting arms is provided with a first buckle tongue. The plurality of connecting arms is spaced apart, and a retaining space is formed by the plurality of connecting arms. The first female buckle member comprises a first base and a blocking piece provided on an end of the first base. The first base is provided with a through-hole in a center of the first base, and the through-hole passes through the blocking piece. The mounting hole is a step-shaped through-hole with a step. The first female buckle member is configured to be inserted into the mounting hole, and the blocking piece of the first female buckle member is configured to abut against the step of the step-shaped through-hole. The plurality of connecting arms of the first male buckle member are configured to be inserted into the through-hole of the first base, and the first buckle tongue is configured to abut against the blocking piece of the first female buckle member, so that the first male buckle member and the first female buckle member are buckled together.

Furthermore, the blocking piece is provided with a recess in communication with the through-hole, and the first buckle tongue of the first male buckle member is configured to abut against a bottom of the recess.

Furthermore, the first male buckle member further comprises a position-restraining portion provided on the inserting axis. The position-restraining portion is projected on an outer surface of the inserting axis. The position-restraining portion is configured to abut against an inner surface of the through-hole of the first base, so that the first male buckle member is secured with the first female buckle member.

Furthermore, the position-restraining portion is a protruding rib in parallel to an axial direction of the inserting axis. A height of the protruding rib above the inserting axis is gradually increased from an end adjacent to the plurality of connecting arms toward the other end.

Furthermore, the first male buckle member further comprises a first mounting portion. The first mounting portion is configured to be disposed on the first male buckle member at an end remote from end with the first buckle tongue. The first mounting portion and the mounting groove are configured to cooperate so that the first male buckle member is secured to the wing.

Furthermore, the first mounting portion comprises a horizontal plate and a pair of vertical plates. The horizontal plate is provided on an end of the first male buckle member away from end of the first buckle tongue. The pair of vertical plates extends from a side of the horizontal plate. The pair of vertical plates is disposed to intersect each other. The mounting groove comprises a pair of insertion slots disposed to intersect each other. The pair of vertical plates is configured to be inserted into the pair of insertion slots respectively.

Furthermore, the second male female buckle comprises a second male buckle member and a second female buckle member that are configured to cooperate with each other. The second male buckle member is configured to be mounted on the body, the second female buckle member is configured to be mounted on the vertical tail, and the second male buckle member and the second female buckle member are configured to cooperate to secure the vertical tail on the body. Alternatively, the second male buckle member is configured to be mounted on the vertical tail, the second female buckle member is configured to be mounted on the body, and the second male buckle member and the second female buckle member are configured to cooperate to secure the vertical tail on the body.

Furthermore, the body and vertical tail are respectively provided with a first mounting position and a second mounting position. The second male buckle member is configured to be mounted to the first mounting position. The second female buckle member is configured to be mounted on the second mounting position.

Furthermore, the second male buckle member comprises a second mounting portion, a neck portion projected on a side of the second mounting portion, and a second buckle tongue formed from an extension of the neck portion. The second female buckle member comprises a second base and an engaging groove provided on the second base. The second buckle tongue is configured to be inserted into the engaging groove and abut against the engaging groove, so that the second male buckle member is secured with the second female buckle member.

Furthermore, the second base is provided with a pair of oppositely disposed snap buckles. The engaging groove is formed between the snap buckles, and the second buckle tongue is configured to be stopped by the snap buckles.

Furthermore, the second base comprises a base piece and a pair of symmetrically disposed L-shaped pieces at both ends of the base piece. The snap buckles are projected on the base piece. The neck portion is configured to be sandwiched between the snap buckles. The L-shaped pieces are configured to abut against the second mounting portion of the second male buckle member.

Furthermore, the model aircraft further comprises at least one third male female buckle, and the third male female buckle is configured to secure the wing on the body.

The present disclosure provides the following benefits: in the disclosed model aircraft, the wing and the vertical tail can be removably assembled on the body by multiple male female buckles; it is structurally simple; it is convenient to disassemble the aircraft during storage to save space, and it is convenient and fast to assemble the aircraft during use, thereby improving the ease of assembly.

BRIEF DESCRIPTION OF FIGURES

In order to more clearly illustrate the technical schemes, the following embodiments are illustrated together with the accompanying drawings. It is obvious that the following descriptions of the drawings depict only some embodiments. Those skilled in the art may derive other drawings from the current drawings without any inventive effort.

DETAILED DESCRIPTION

Figure 1:
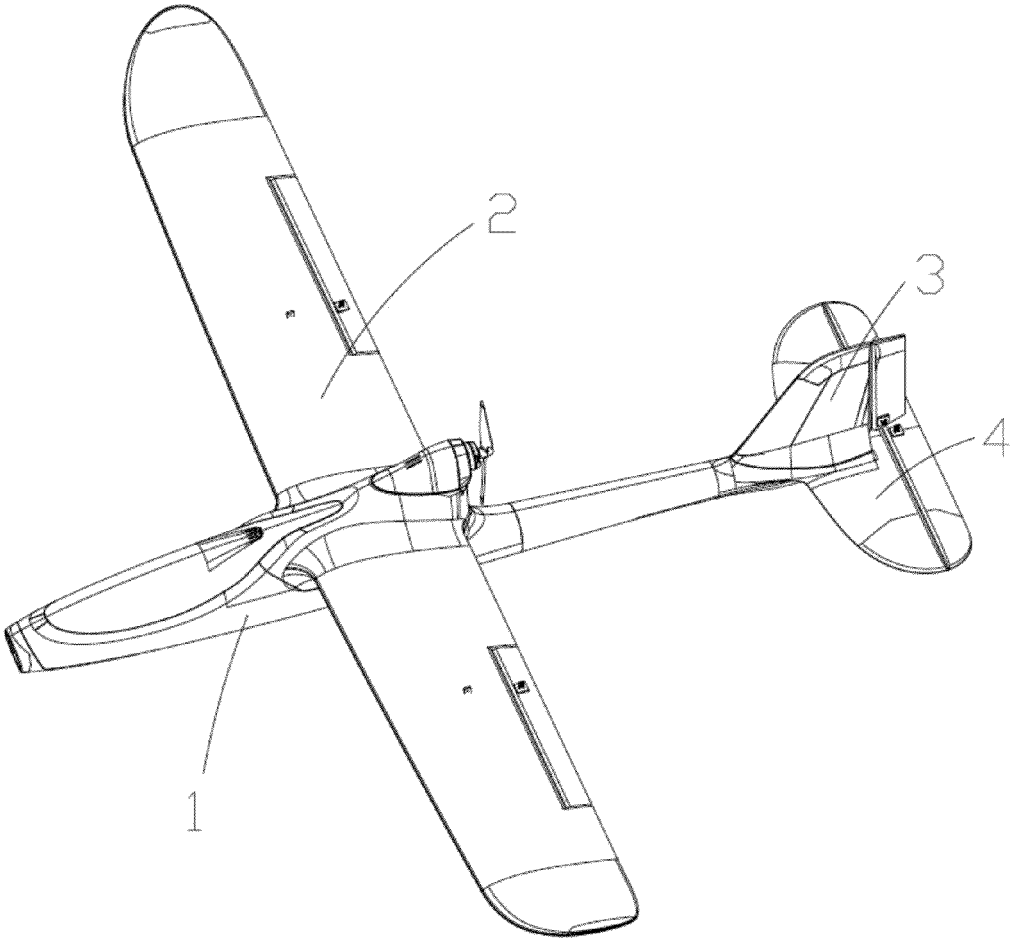
FIG. 1 is a schematic structural view of the presently disclosed model aircraft.
Figure 2:
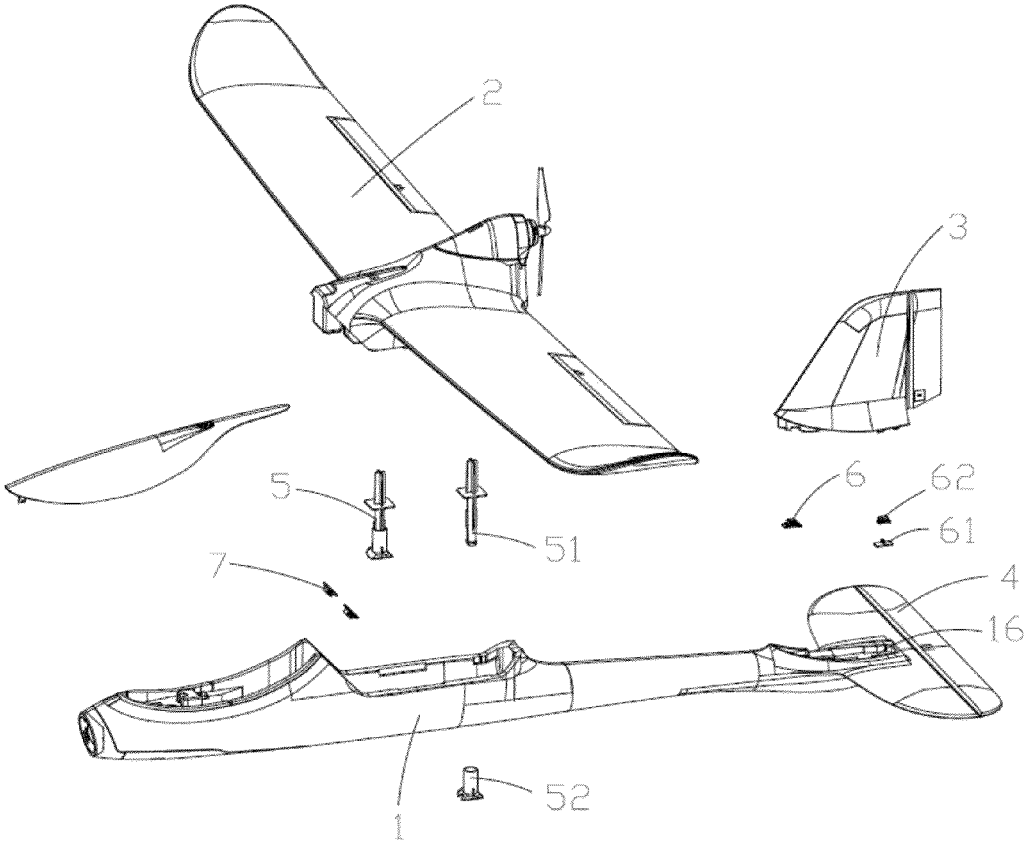
FIG. 2 is an exploded view of the embodiment in FIG. 1.
Figure 3:
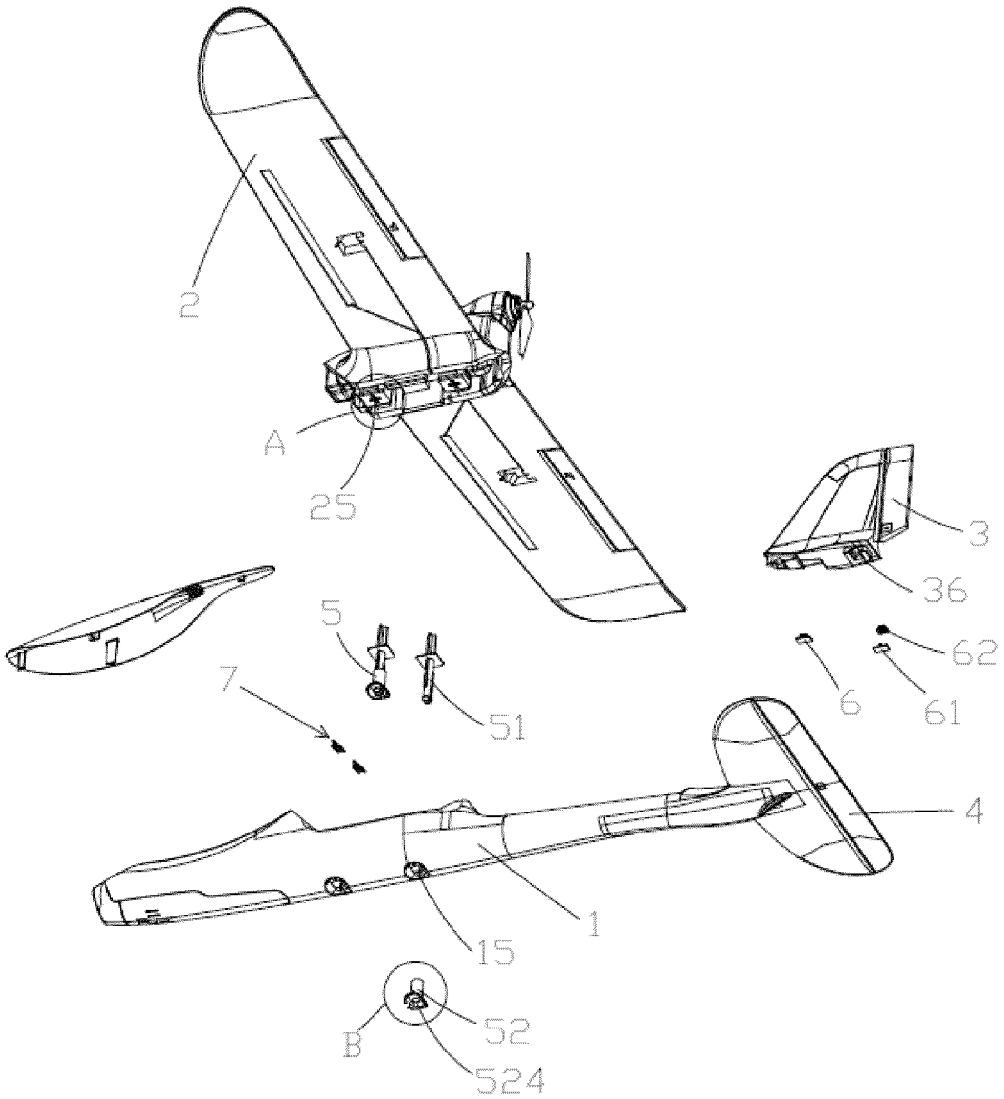
FIG. 3 is a exploded view of the embodiment in FIG. 1 from another perspective.
Figure 4:
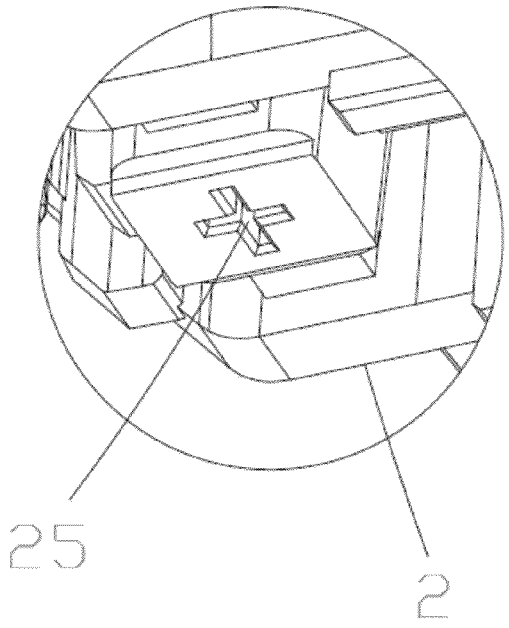
FIG. 4 is a partial enlarged view at area A of FIG. 3.
Figure 5:
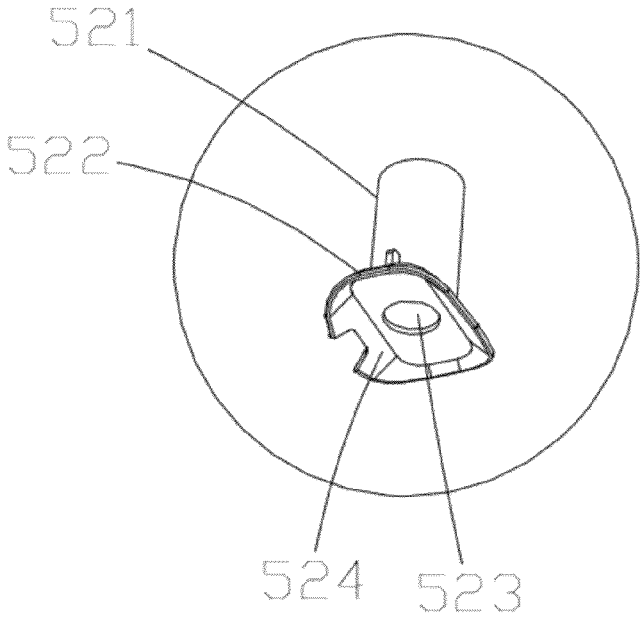
FIG. 5 is a partial enlarged view at area B of FIG. 3.

Below are a detailed description of the embodiments of the disclosure in view of the accompanying drawings, and the clear and detailed description of the technical schemes of the present disclosure.

As shown in FIG. 1-5, the disclosure provides a model aircraft comprising a body 1, a wing 2, a vertical tail 3 and a horizontal tail 4. At least one first male female buckle 5 is provided between the wing 2 and the body 1. Said wing is securely mounted on the body 1 through the first male female buckle 5. At least one second male female buckle 6 is provided between the vertical tail 3 and the body 1. The vertical tail 3 is securely mounted on the body 1 through the second male female buckle. Said horizontal tail and body 1 is in the form of a one-piece unit. During disassembly and assembly, it is only needed to disassemble the wing 2 and vertical tail 3 from the body 1, or assemble of the same. The disassembly and assembly is easy and helps to improve work efficiency. In the present embodiment, said model aircraft comprises two of the first male female buckles 5 and two of the second male female buckles 6. In other embodiments, other numbers of the first male female buckles 5 and the second male female buckles 6 may be provided, such as three of the first male female buckles 5 and three of the second male female buckles 6.

Said first male female buckle 5 comprises a first male buckle member 51 and a first female buckle member 52 that are configured to cooperate with each other. In the present embodiment, the first male buckle member 51 is configured to be mounted on the wing 2, the first female buckle member 52 is configured to be mounted on the body 1, and the first male buckle member 51 and the first female buckle member 52 are configured to cooperate to secure the wing 2 on the body 1; a mounting groove 25 is provided at a bottom of the wing 2; an end of the first male buckle member 51 is configured to be secured in the mounting groove 25; a mounting hole 15 is provided at a bottom of the body 1, and an end of the first female buckle member 52 is configured to pass through the mounting hole 15 and is configured to be stopped by a bottom of the mounting hole 15. Without being limited to this, alternatively, the first male buckle member 51 is configured to be mounted on the body 1, the first female buckle member 52 is configured to be mounted on the wing 2, and the first male buckle member 51 and the first female buckle member 52 are configured to cooperate to secure the wing 2 on the body 1.

Figure 6:
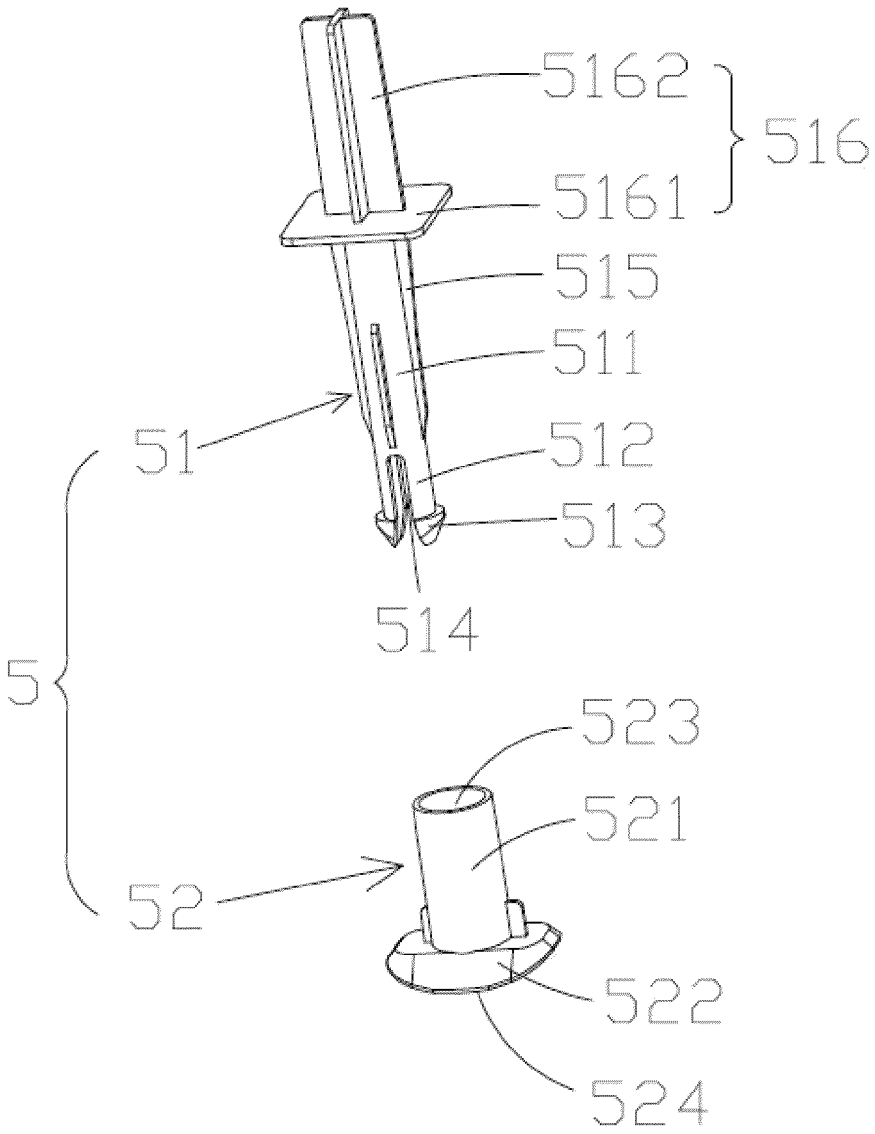
FIG. 6 is a schematic structural view of a first male female buckle of the disclosed model aircraft.

As shown in FIG. 6, the first male buckle member 51 comprises an inserting axis 511 and a plurality of connecting arms 512 formed from an extension of an end of the inserting axis 511. A free end of one of the plurality of connecting arms 512 is provided with a first buckle tongue 513. The plurality of connecting arms 512 are spaced apart, and a retaining space 514 is formed by the plurality of connecting arms 512. According to the present embodiment, the first male buckle member 51 is made of elastic material. When being pressed by external force, said connecting arms 512 deform toward the retaining space 514 and retract to be closer. The first female buckle member 52 comprises a first base 521 and a blocking piece 522 provided on an end of the first base 521; the first base 521 is provided with a through-hole 523 in a center of the first base 521, and the through-hole 523 passes through the blocking piece 522. According to the present embodiment, the mounting hole 15 is a step-shaped through-hole with a step. When the first male female buckle 5 is buckled together, the first female buckle member 52 is configured to be inserted into the mounting hole 15, and the blocking piece 522 of the first female buckle member 52 is configured to abut against the step of the step-shaped through-hole. Therefore the blocking piece 522 of said first female buckle member 52 is retained within the mounting hole 15, and this ensures the smooth look of the exterior of the aircraft. When the first male buckle member 51 and the first female buckle member 52 are buckled together, the plurality of connecting arms 512 of the first male buckle member 51 are configured to be inserted into the through-hole 523 of the first base, and the first buckle tongue 513 is configured to abut against the blocking piece 522 of the first female buckle member 52.

The blocking piece 522 is provided with a recess 524 in communication with the through-hole 523, and the first buckle tongue 513 of the first male buckle member 51 is configured to abut against a bottom of the recess 524. When the first male buckle member 51 and the first female buckle member 52 are buckled together, the connecting arms 512 of the first male buckle member 51 are inserted into the through-hole 523; the first buckle tongues 513 at the free end of the connecting arms 512 are deformed by the pressing force of the interior wall of through-hole 523, and retract to be closer; further insertion of the inserting axis 511 of the male buckle member 51 pushes the first buckle tongue 513 out of the through-hole 523; the first buckle tongue 513 bulges outwardly due to the lack of the pressing force from the wall of the through-hole 523; when the inserting axis 511 is pulled back, the first buckle tongue 513 abuts against the blocking piece 522 of the first female buckle member 52, and therefore cannot retract back into the through-hole 523; thus, the first male buckle member 51 and the first female buckle member 52 are buckled together, and the first buckle tongue 513 is retained in the recess 524.

When the first male female buckle is to be separated, the first buckle tongues 513 are to be pressed toward their center so that multiple first buckle tongues 513 are closed together and inserted into the through-hole 523 of the first female buckle member 52; the first male buckle member 51 is then applied a force away from the first female buckle member 52, and the first male buckle member 51 is pulled back from the first female buckle member 52, so that the first male female buckle is separated; the wing 2 is also separated from the body 1. Therefore, the disassembly of the wing 2 from the body 1 is simple and convenient.

Furthermore, the first male buckle member 51 further comprises a position-restraining portion 515 provided on the inserting axis 511. The position-restraining portion 515 is projected on an outer surface of the inserting axis 511. The position-restraining portion 515 is configured to abut against an inner surface of the through-hole 523, so that the first male buckle member 51 is secured with the first female buckle member 52. This restricts the buckle position of the first female buckle member 52, and prevents the first male buckle member 51 to become loose from the first female buckle member 52 after the first male buckle member 51 and first female buckle member 52 are buckled together.

According to the present embodiment, the position-restraining portion 515 is a protruding rib in parallel to an axial direction of the inserting axis 511. A height of the protruding rib above the inserting axis 511 is gradually increased from an end adjacent to the plurality of connecting arms 512 toward the other end. That is, the outer surface of the protruding rib is at an angle to the axial direction of the inserting axis 511; when inserting axis 511 enters the through-hole 523 of the first female buckle member 52, the first female buckle member 52 may not go through the other end of the inserting axis 511 due to the position restriction function of the protruding ribs.

Furthermore, the first male buckle member 51 further comprises a first mounting portion 516. The first mounting portion 516 is configured to be disposed on the first male buckle member 51 at an end remote from end with the first buckle tongue 513. The first mounting portion 516 and the mounting groove 25 are configured to cooperate so that the first male buckle member 51 is secured to the wing.

According to an embodiment, the first mounting portion 516 comprises a horizontal plate 5161 and a pair of vertical plates 5162. The horizontal plate 5161 is provided on an end of the first male buckle member 51 away from end of the first buckle tongue 513. The pair of vertical plates 5161 extends from a side of the horizontal plate 5161. The pair of vertical plates 5162 is disposed to intersect each other; FIG. 6 shows a vertical cross. The mounting groove 25 comprises a pair of insertion slots disposed to intersect each other. During assembly, the pair of vertical plates 5162 is respectively inserted into the pair of insertion slots, and the first male buckle member 51 is secured with the wing 2 by Interference fit. In other embodiments, the first male buckle member 51 may be secured with the wing 2 through other fixing methods such as through bonding.

The second male female buckle 6 comprises a second male buckle member 61 and a second female buckle member 62 that are configured to cooperate with each other. The second male buckle member 61 is configured to be mounted on the body 1, the second female buckle member 62 is configured to be mounted on the vertical tail 3, and the second male buckle member 61 and the second female buckle member 62 are configured to cooperate to secure the vertical tail 3 on the body 1. Without being limited to the above, alternatively, the second male buckle member 61 is configured to be mounted on the vertical tail 3, the second female buckle member 62 is configured to be mounted on the body 1, and the second male buckle member 61 and the second female buckle member 62 are configured to cooperate to secure the vertical tail 3 on the body 1. The body 1 and vertical tail 3 are respectively provided with a first mounting position 16 and a second mounting position 36, to secure the assembly of the second male buckle member 61 and second female buckle 62. The second male buckle member 61 and second female buckle 62 are respectively bonded to the first mounting position 16 and the second mounting position 36 by sticky materials such as glue or double-sided tape.

Figure 7:
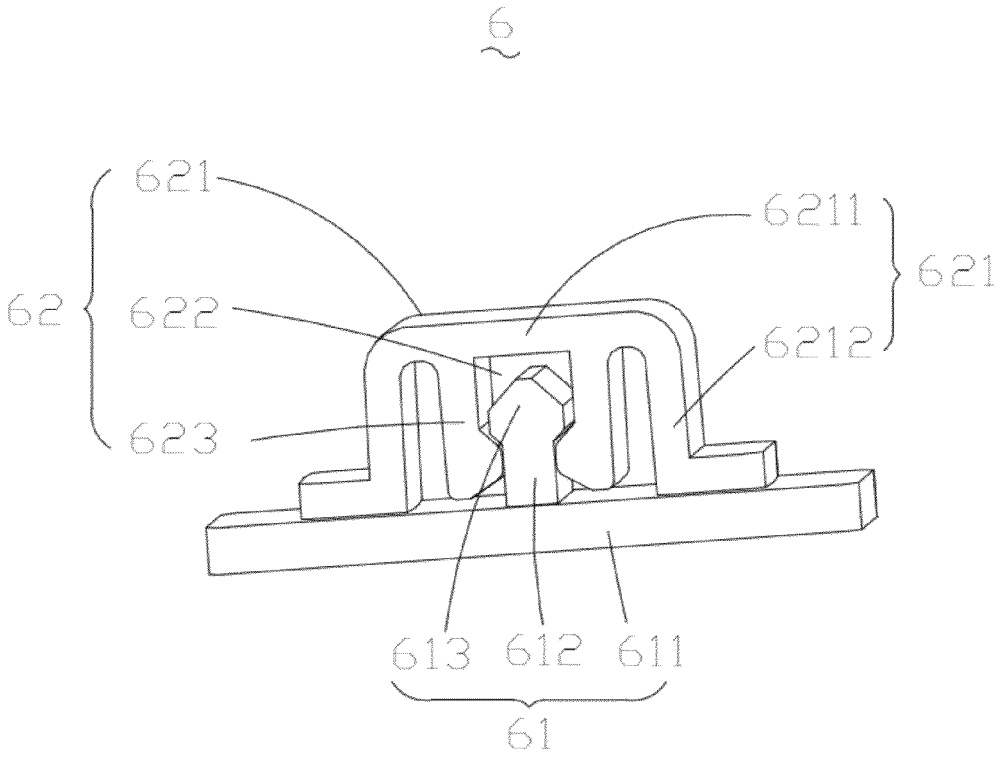
FIG. 7 is a schematic structural view of a second male female buckle of the disclosed model aircraft.

As shown in FIG. 7, the second male buckle member 61 comprises a second mounting portion 611, a neck portion 612 projected on a side of the second mounting portion 611, and a second buckle tongue 613 formed from an extension of the neck portion 612. The second mounting portion 611 is configured to secure the second male buckle member 61 on the wing 1; and the second buckle tongue 613 is configured to buckle with the second female buckle member 62. Furthermore, the second mounting portion 611 is mounted on the first mounting position 16. The first mounting position 16 is a recess slot or a plane surface. The second mounting portion 611 is bonded on the first mounting position 16. The second female buckle member 62 comprises a second base 621 and an engaging groove 622 provided on the second base 621. The second buckle tongue 613 is configured to be inserted into the engaging groove 622 and abut against the engaging groove 622, so that the second male buckle member 61 is secured with the second female buckle member 62. The second base 621 is provided with a pair of oppositely disposed snap buckles 623, with the snap portions being arranged to be opposing to each other. The engaging groove 622 is formed between the snap buckles 623, and the second buckle tongue 613 is configured to be stopped by the snap buckles 623.

When the second male female buckle 6 is buckled, the second buckle tongue 613 is inserted into the engaging groove 622 through the opening of the engaging groove 622; interior walls of the snap buckles 623 are pushed to expand outwardly; the opening of the engaging groove 622 expands so that the second buckle tongue 613 may be inserted into the engaging groove 622. When the second buckle tongue 613 is completely inserted into the engaging groove 622, the snap buckles 623 springs back to snap the second buckle tongue 613, so that the second male female buckle is buckled together; thus the vertical tail 3 is mounted on the wing 1 and the assembly process is convenient.

When the vertical tail 3 is to be disassembled from the wing 1, the second male buckle member 61 and the second female buckle member 62 are applied with forces toward opposite directions. Snap buckle 23 is pushed outwardly by the second buckle tongue 613 and is expanded. The second buckle tongue 613 is pulled back from the opening of the engaging groove 622, so that the second male buckle member 61 is separated from the second female buckle member 62. The disassembly process is very convenient as well.

According to an embodiment, the second base 621 comprises a base piece 6211 and a pair of symmetrically disposed L-shaped pieces 6212 at both ends of the base piece 6211. The snap buckles 623 are projected on the base piece 6211. When the second male buckle 61 and the second female buckle member 62 are buckled together, the neck portion 612 is sandwiched between the snap buckles 623. The L-shaped pieces 6212 are configured to abut against the second mounting portion 611 of the second male buckle member 61. The second base 621 is to be bonded on the second mounting position 36; the second mounting position 36 is a recess groove, with a shape matching the exterior shape of the second base 621; thus the second female buckle member is configured to be accommodated in the second mounting position 36.

As a further improvement in the disclosure, at least one third male female buckle 7 is provided between the wing 2 and the body 1 to further secure the wing 2, and the wing 2 is more securely assembled on the body 1. According to an embodiment, preferably two of third male female buckles 7 are provided. The third male female buckles 7 may have the same structure of the second male female buckle, and have the same mode of assembly, which are not described in detail herein. The third male female buckle 7 and the first male female buckle 5 are respectively provided on different connecting interfaces of the wing 2 and the body 1, to ensure that each connecting interface is securely connected and the wing 2 is tightly assembled on the body 1.

The structures of the first, second and third male female buckle 5, 6 and 7 are not limited to the above disclosures and other male female buckles that implement disassembly and assembly functions may also be employed.

The descriptions above are preferred embodiments. Thus, it will be apparent to one skilled in the art that modifications may be made without departing from the protection scope of the claims set out below, and such modifications are within the protective scope of the present disclosure.

We claim:

1. A model aircraft, comprising a body and a horizontal tail in a form of a one-piece unit, a wing and a vertical tail;

wherein the model aircraft further comprises at least one first male female buckle and at least one second male female buckle;

wherein the wing is configured to be mounted on the body by the first male female buckle;

wherein the vertical tail is configured to be mounted on the body by the second male female buckle;

wherein the first male female buckle comprises a first male buckle member and a first female buckle member that are configured to cooperate with each other;

wherein the first male buckle member is configured to be mounted on the wing, the first female buckle member is configured to be mounted on the body, and the first male buckle member and the first female buckle member are configured to cooperate to secure the wing on the body; or wherein the first male buckle member is configured to be mounted on the body, the first female buckle member is configured to be mounted on the wing, and the first male buckle member and the first female buckle member are configured to cooperate to secure the wing on the body;

wherein a mounting groove is provided at a bottom of the wing, and an end of the first male buckle member is configured to be secured in the mounting groove;

wherein a mounting hole is provided at a bottom of the body, and an end of the first female buckle member is configured to pass through the mounting hole and is configured to be stopped by a bottom of the mounting hole;

wherein the first male buckle member comprises an inserting axis and a plurality of connecting arms formed from an extension of an end of the inserting axis;

wherein a free end of one of the plurality of connecting arms is provided with a first buckle tongue; wherein the plurality of connecting arms are spaced apart, and a retaining space is formed by the plurality of connecting arms;

wherein the first female buckle member comprises a first base and a blocking piece provided on an end of the first base;

wherein the first base is provided with a through-hole in a center of the first base, and the through-hole passes through the blocking piece;

wherein the mounting hole is a step-shaped through-hole with a step;

wherein the first female buckle member is configured to be inserted into the mounting hole, and the blocking piece of the first female buckle member is configured to abut against the step of the step-shaped through-hole;

wherein the plurality of connecting arms of the first male buckle member are configured to be inserted into the through-hole of the first base, and the first buckle tongue is configured to abut against the blocking piece of the first female buckle member, so that the first male buckle member and the first female buckle member are buckled.

2. The model aircraft according to claim 1, wherein the blocking piece is provided with a recess in communication with the through-hole, and the first buckle tongue of the first male buckle member is configured to abut against a bottom of the recess.

3. The model aircraft according to claim 1, wherein the first male buckle member further comprises a position-restraining portion provided on the inserting axis; wherein the position-restraining portion is projected on an outer surface of the inserting axis;

wherein the position-restraining portion is configured to abut against an inner surface of the through-hole of the first base, so that the first male buckle member is secured with the first female buckle member.

4. The model aircraft according to claim 1, wherein the position-restraining portion is a protruding rib in parallel to an axial direction of the inserting axis;

wherein a height of the protruding rib above the inserting axis is gradually increased from an end adjacent to the plurality of connecting arms toward the other end.

5. The model aircraft according to claim 1, wherein the first male buckle member further comprises a first mounting portion; wherein the first mounting portion is configured to be disposed on the first male buckle member at an end remote from end with the first buckle tongue;

wherein the first mounting portion and the mounting groove are configured to cooperate so that the first male buckle member is secured to the wing.

6. The model aircraft according to claim 5, wherein the first mounting portion comprises a horizontal plate and a pair of vertical plates;

wherein the horizontal plate is provided on an end of the first male buckle member away from end of the first buckle tongue;

wherein the pair of vertical plates extends from a side of the horizontal plate; the pair of vertical plates is disposed to intersect each other;

wherein the mounting groove comprises a pair of insertion slots disposed to intersect each other;

wherein the pair of vertical plates are configured to be inserted into the pair of insertion slots respectively.

7. The model aircraft according to claim 1, wherein the second male female buckle comprises a second male buckle member and a second female buckle member that are configured to cooperate with each other;

wherein the second male buckle member is configured to be mounted on the body, the second female buckle member is configured to be mounted on the vertical tail, and the second male buckle member and the second female buckle member are configured to cooperate to secure the vertical tail on the body; or wherein the second male buckle member is configured to be mounted on the vertical tail, the second female buckle member is configured to be mounted on the body, and the second male buckle member and the second female buckle member are configured to cooperate to secure the vertical tail on the body.

8. The model aircraft according to claim 7, wherein the body and vertical tail are respectively provided with a first mounting position and a second mounting position;

wherein the second male buckle member is configured to be mounted to the first mounting position; wherein the second female buckle member is configured to be mounted on the second mounting position.

9. The model aircraft according to claim 7, wherein the second male buckle member comprises a second mounting portion, a neck portion projected on a side of the second mounting portion, and a second buckle tongue formed from an extension of the neck portion;

wherein the second female buckle member comprises a second base and an engaging groove provided on the second base;

wherein the second buckle tongue is configured to be inserted into the engaging groove and abut against the engaging groove, so that the second male buckle member is secured with the second female buckle member.

10. The model aircraft according to claim 9, wherein the second base is provided with a pair of oppositely disposed snap buckles;

wherein the engaging groove is formed between the snap buckles, and the second buckle tongue is configured to be stopped by the snap buckles.

11. The model aircraft according to claim 10, wherein the second base comprises a base piece and a pair of symmetrically disposed L-shaped pieces at both ends of the base piece;

wherein the snap buckles are projected on the base piece;

wherein the neck portion is configured to be sandwiched between the snap buckles;

wherein the L-shaped pieces are configured to abut against the second mounting portion of the second male buckle member.

12. The model aircraft according to claim 1, further comprising at least one third male female buckle, wherein the third male female buckle is configured to secure the wing on the body.

13. The model aircraft according to claim 1, wherein the model aircraft comprises at least two first male female buckles positioned along a roll axis of the model aircraft.

14. The model aircraft according to claim 13, wherein the at least two first male female buckles are in a plane spanned by a yaw axis and a roll axis of the model aircraft.

15. The model aircraft according to claim 1, wherein the first male buckle member comprises a pair of vertical plates that form a cross.

16. The model aircraft according to claim 1, wherein the mounting groove comprises a pair of slots that form a cross.

17. A model aircraft, comprising a body and a horizontal tail in a form of a one-piece unit, a wing and a vertical tail;

wherein the model aircraft further comprises at least one first male female buckle and at least one second male female buckle;

wherein the wing is configured to be mounted on the body by the first male female buckle;

wherein the vertical tail is configured to be mounted on the body by the second male female buckle;

wherein the second male female buckle comprises a second male buckle member and a second female buckle member that are configured to cooperate with each other;

wherein the second male buckle member is configured to be mounted on the body, the second female buckle member is configured to be mounted on the vertical tail, and the second male buckle member and the second female buckle member are configured to cooperate to secure the vertical tail on the body; or wherein the second male buckle member is configured to be mounted on the vertical tail, the second female buckle member is configured to be mounted on the body, and the second male buckle member and the second female buckle member are configured to cooperate to secure the vertical tail on the body;

wherein the body and vertical tail are respectively provided with a first mounting position and a second mounting position;

wherein the second male buckle member is configured to be mounted to the first mounting position; wherein the second female buckle member is configured to be mounted on the second mounting position;

wherein the second male buckle member comprises a second mounting portion, a neck portion projected on a side of the second mounting portion, and a second buckle tongue formed from an extension of the neck portion;

wherein the second female buckle member comprises a second base and an engaging groove provided on the second base;

wherein the second buckle tongue is configured to be inserted into the engaging groove and abut against the engaging groove, so that the second male buckle member is secured with the second female buckle member;

wherein the second base is provided with a pair of oppositely disposed snap buckles;

wherein the engaging groove is formed between the snap buckles, and the second buckle tongue is configured to be stopped by the snap buckles.

18. The model aircraft according to claim 17, wherein the second base comprises a base piece and a pair of symmetrically disposed L-shaped pieces at both ends of the base piece;

wherein the snap buckles are projected on the base piece;

wherein the neck portion is configured to be sandwiched between the snap buckles;

wherein the L-shaped pieces are configured to abut against the second mounting portion of the second male buckle member.

19. The model aircraft according to claim 17, further comprising at least one third male female buckle, wherein the third male female buckle is configured to secure the wing on the body.

20. The model aircraft according to claim 17, wherein the model aircraft comprises at least two first male female buckles positioned along a roll axis of the model aircraft.

* * * * *